US007635219B2

(12) United States Patent
Seyr et al.

(10) Patent No.: US 7,635,219 B2
(45) Date of Patent: Dec. 22, 2009

(54) DIVER'S WATCH

(75) Inventors: Ernst F. Seyr, Linz (AT); Stéphane Lauber, Tramelan (CH)

(73) Assignee: Eterna SA FAbrique D'Horlogerie, Grenchen (CH)

( * ) Notice: Subject to any disclaimer, the term of this patent is extended or adjusted under 35 U.S.C. 154(b) by 155 days.

(21) Appl. No.: 11/721,111

(22) PCT Filed: Dec. 8, 2005

(86) PCT No.: PCT/EP2005/056616

§ 371 (c)(1),
(2), (4) Date: Sep. 13, 2007

(87) PCT Pub. No.: WO2006/061422

PCT Pub. Date: Jun. 15, 2006

(65) Prior Publication Data

US 2008/0304372 A1 Dec. 11, 2008

(30) Foreign Application Priority Data

Dec. 8, 2004 (EP) ..... 04405761

(51) Int. Cl.
*A44C 5/00* (2006.01)
*G04B 39/00* (2006.01)

(52) U.S. Cl. ..... 368/283; 368/295; 368/313

(58) Field of Classification Search ..... 368/88, 368/276, 281, 283, 286, 294, 295, 309, 310, 368/313

See application file for complete search history.

(56) References Cited

U.S. PATENT DOCUMENTS

| | | | | | |
|---|---|---|---|---|---|
| 1,303,888 | A | * | 5/1919 | Gruen | 368/283 |
| 1,493,248 | A | * | 5/1924 | Davidoff | 368/283 |
| 3,505,808 | A | * | 4/1970 | Eschle | 368/10 |
| 4,815,053 | A | * | 3/1989 | Dal Busco | 368/294 |
| 5,005,161 | A | * | 4/1991 | Boilen | 368/295 |
| D352,469 | S | * | 11/1994 | Schlup | D10/39 |
| 6,079,872 | A | * | 6/2000 | Besson | 368/281 |

(Continued)

FOREIGN PATENT DOCUMENTS

| | | |
|---|---|---|
| CH | 346826 | 5/1960 |

(Continued)

OTHER PUBLICATIONS

Automated English Translation (Abstract Only) of above Foreign Patent (D) No. CH655633 as obtained from website http://www.espacenet.com (English translation was readily available of Abstract only).

(Continued)

*Primary Examiner*—Vit W Miska
(74) *Attorney, Agent, or Firm*—Townsend M. Belser, Jr.; Nexsen Pruet, LLC

(57) ABSTRACT

A diver's watch having a frame (22) and a case (10) containing a clockwork movement associated with time displaying means (15, 16). The case includes a middle (11), a base (12) and a rotating bezel (13). The case is hinge mounted on the frame (22), which is configured so as to define a housing wherein the case can be folded down to take up a position preventing its bezel from rotating and wherefrom it can be retrieved to allow its rotation.

25 Claims, 5 Drawing Sheets

U.S. PATENT DOCUMENTS

| | | | | |
|---|---|---|---|---|
| 6,200,019 | B1 | 3/2001 | Latini | |
| 6,379,037 | B1 | 4/2002 | Saleh et al. | |
| 7,072,247 | B2 * | 7/2006 | Hiranuma et al. | 368/88 |
| 2001/0040840 | A1 | 11/2001 | Terasawa et al. | |
| 2008/0037375 | A1 * | 2/2008 | Ellner et al. | 368/88 |

FOREIGN PATENT DOCUMENTS

| | | |
|---|---|---|
| CH | 655 633 | 5/1986 |
| EP | 0562522 | 9/1993 |
| EP | 1139185 | 10/2001 |

OTHER PUBLICATIONS

English Translation of above Foreign Patent (F) No. ep 0562522.
Automated English Translation (Abstract) of above Foreign Patent (F) No. EP0562522 as obtained from website http://www.espacenet.com.
International Search Report PCT/EP2005/056616 related to subject application.
French Search Report PCT/EP2005/056616 related to subject application.
EP04405761 search report elated to subject application.

* cited by examiner

DIVER'S WATCH

BACKGROUND OF THE INVENTION

1) Field of the Invention

The present invention relates to horology. It more particularly concerns a diver's watch.

2) Description of Related Art

This type of product, in known manner, is equipped with a rotating bezel carrying graduations generally corresponding to sixty minutes. It is initially set by the diver to a time period which, in relation to the position of the minute hand, gives the diver a permanent indication of the time spent underwater or the time left before having to resurface.

It is easy to understand that, throughout the entire diving time, this bezel must necessarily remain immobile despite the various aggressions it may undergo, otherwise the diver may be in serious danger.

The purpose of the present invention is to provide a diver's watch which, while remaining of pleasing appearance, is provided with means which reliably prevent any undue rotation of its bezel.

SUMMARY OF THE INVENTION

More precisely, the invention concerns a diver's watch, characterized in that it comprises:

- a case containing a clockwork movement associated with time display means, said case being formed of a case middle, a back-cover and a rotating bezel, and
- a frame on which the case is hinge mounted, and which is configured so as to define a housing in which the case can be folded down to take up a position preventing rotation of its bezel and wherefrom it can be retrieved to allow its rotation.

Advantageously, the watch of the invention includes means to ensure locking of the case in the frame, these means comprising:

- a fastening member secured to the frame,
- a lever secured to the case able to take up a first position in which it is joined to this member and a second position in which it is separated therefrom, and
- a push-piece secured to the frame and intended to command the lever.

BRIEF DESCRIPTION OF THE DRAWINGS

Other characteristics will become apparent from the following description given with reference to the appended drawings in which.

DETAILED DESCRIPTION OF THE INVENTION

Figure 1:
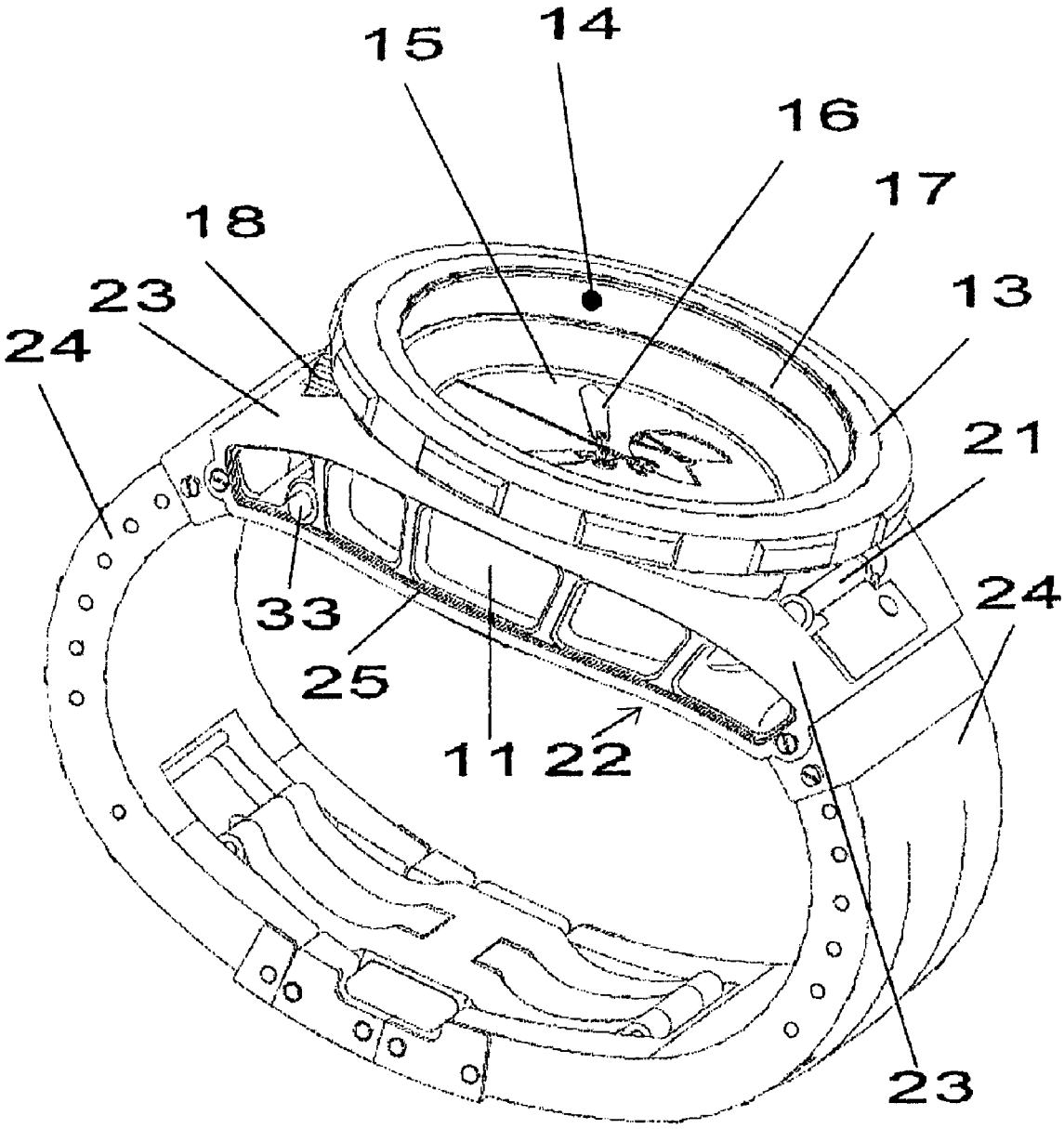
FIGS. 1 and 2 are perspective views of the watch according to the invention, in locked position and released position respectively.

The figures show a round watch case 10 formed of a case middle 11, a back-cover 12 fixed to the middle by screws (not shown in the drawing) and a rotating bezel 13 surrounding a glass 14 and conventionally coupled to the middle. The case contains a clockwork movement displaying current time on a dial 15 by means of hands 16, while the bezel 13 is associated with a ring 17 concentric with the dial and carrying sixty, evenly distributed, graduations corresponding to the sixty minutes of an hour.

It will be noted that the sealed crown 18 used to command movement is arranged at the 12 o'clock position of the dial.

It will also be noted that the rotating bezel 13 has a notably wider outer diameter than the middle 11 thereby offering, in its peripheral portion 19, sixty cavities 20 evenly distributed on the face on the back-cover side of the case, whose purpose will be seen further on.

The case 10 is hinge mounted, at the 6 o'clock position on the dial, by a hinge 21 on a frame 22 whose outer contour follows the contour of the bezel 13 on its sides corresponding to the 3 and 9 o'clock positions. This frame is extended, at the 6 and 12 o'clock positions, by increasingly narrower portions 23 forming means for fastening the links 24 of the watch band.

Figure 4:
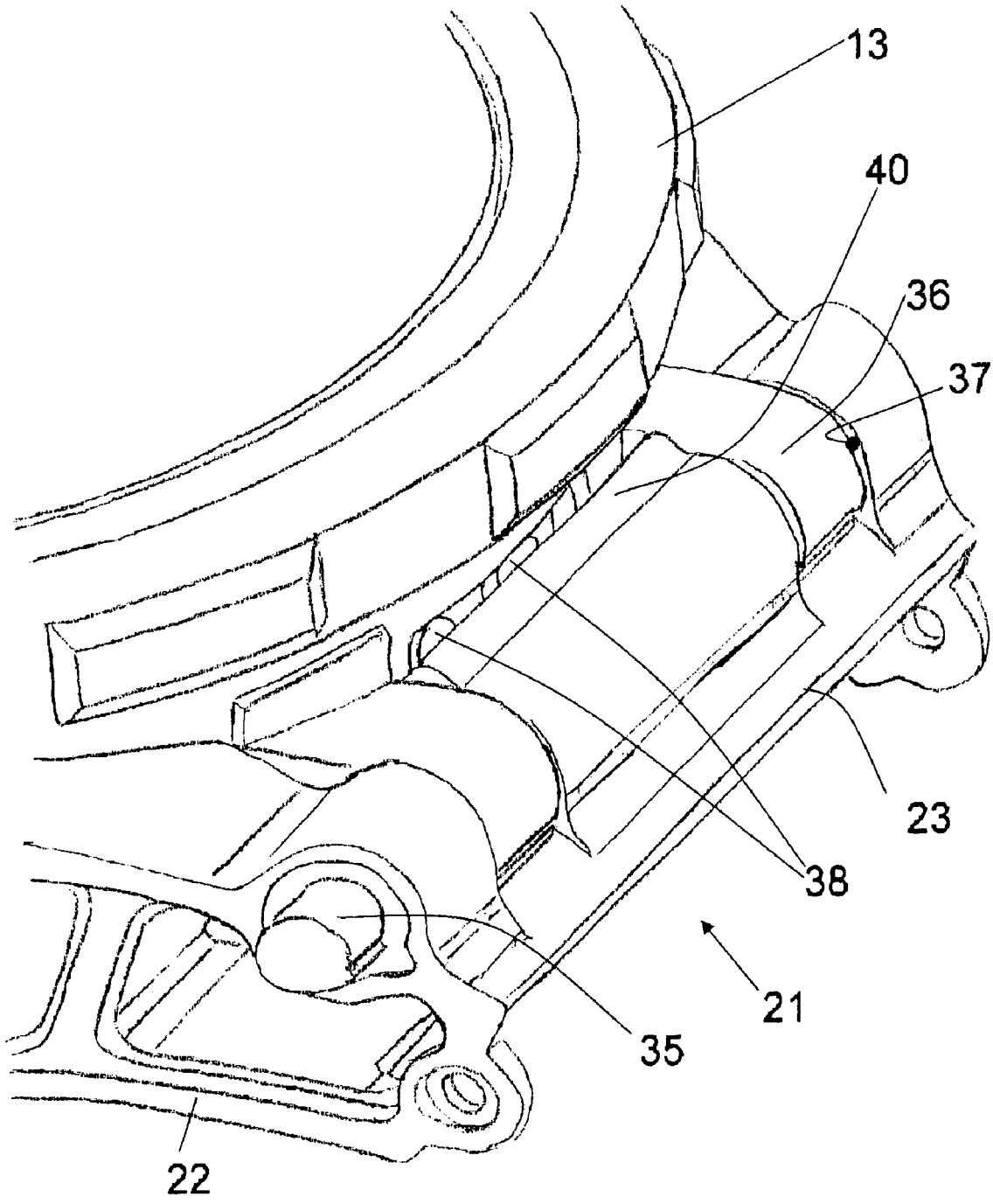
FIG. 4 is a perspective view of one detail of the device according to the invention.
Figure 5:
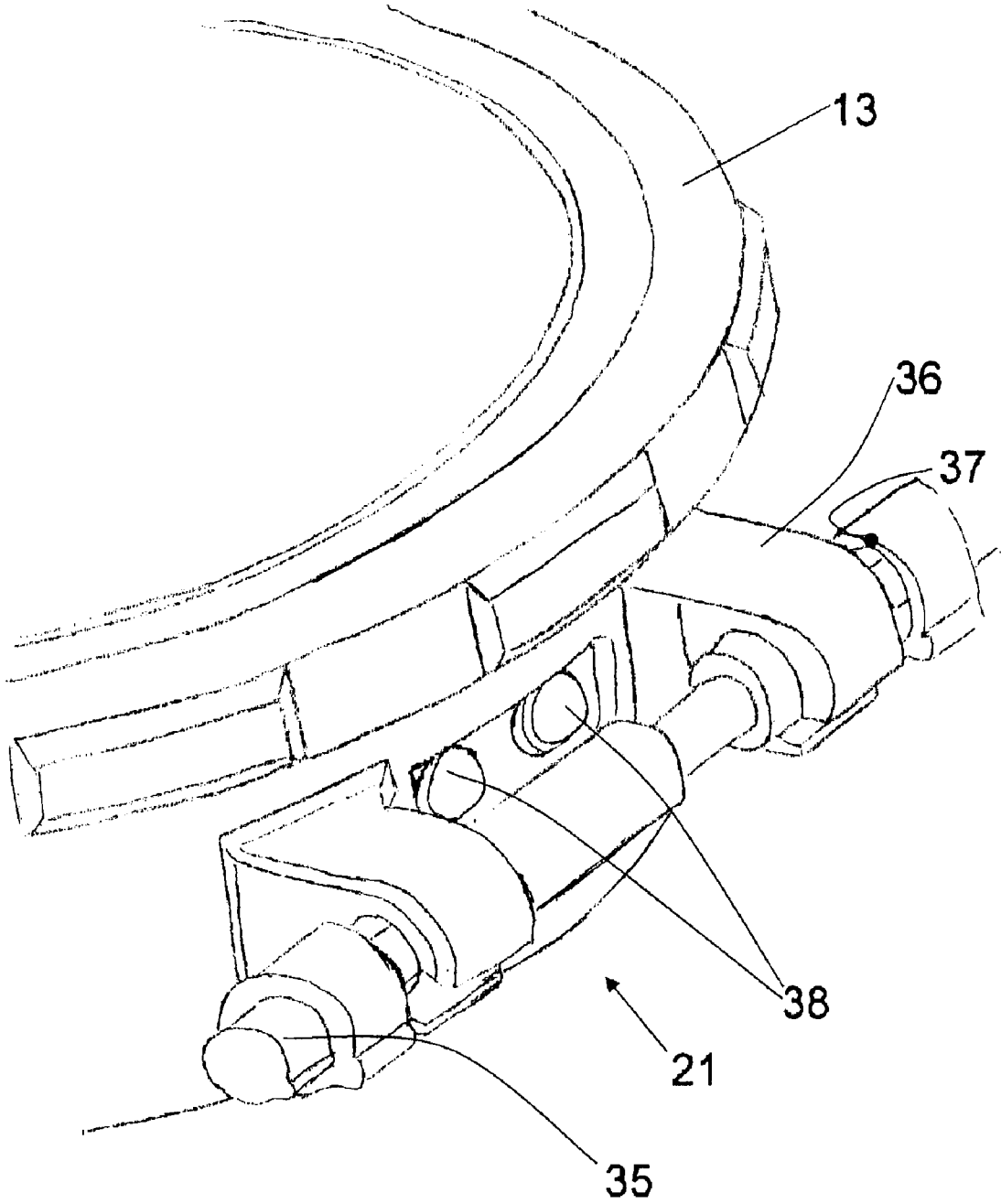
FIG. 5 shows the same detail, but some parts have been omitted for better comprehension.

As illustrated in detail FIGS. 4 and 5, the hinge 21 consists for example of a hinge pin 35 secured to portion 23 of the frame, and of two tubular elements 36 secured to the case 10 and pivoting about the hinge pin 35. This pin is positioned in a channel formed by portion 23 of the frame, the portion being interrupted by grooves 37 which leave pin 35 visible. The tubular elements 36 cooperate with the pin 35 at the grooves 37 and are guided in their pivot movement by the walls of the grooves.

The middle 11, in its area closest to portion 23, is provided with at least one male member 38 arranged so that it projects and has a spring movement. As will be understood below, this member 38 is intended to cooperate with a female member, not shown in the drawing, located in portion 23, to form a catch. Persons skilled in the art may choose the most suitable manner to achieve the catch link. As proposed in the figures, the male member 38 may be formed of two balls mounted mobile in the thickness of the middle 11 and held in position outside the middle 11 by a spring arranged in a housing formed in the middle. The female member may be formed of a hollow made in portion 23. Advantageously the hollow lies below the median plane of the case and is oriented downwardly i.e. towards the back-cover of the case.

The area of portion 23 provided with the female member is also provided with a blocker whose role will be seen below. This blocker consists of a protuberance 40 e.g. in the form of a bar oriented parallel to the pin of the hinge 21 and located slightly below the hollow.

The inside of the frame 22 is configured and sized to receive the crown 18, middle 11 and back-cover 12 but not to allow entry of the bezel 13 which comes to lie on the frame arms 25 adjacent to the 3 and 9 o'clock positions. At least one of these arms is provided in its upper part with a pin 26 intended to take up position in one of the sixty cavities 20 of the rotating bezel 13 so as to immobilize the bezel when it is placed back over it.

Figure 2:
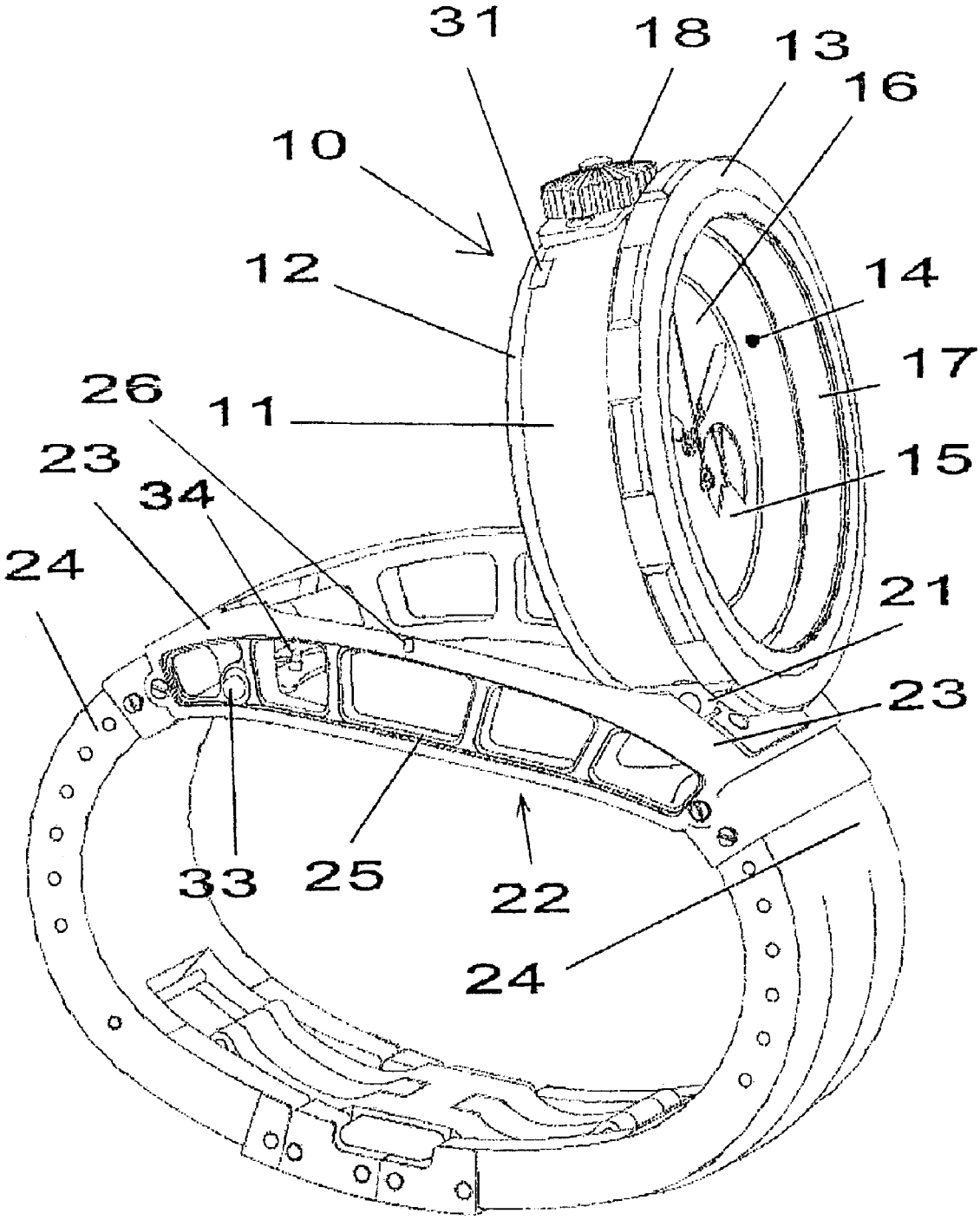

As shown FIGS. 1 and 2, the arms 25 are advantageously perforated to lighten the weight of the watch and reinforce its pleasing appearance by contrast between the colour of the arms and the colour of the middle 11.

Figure 3:
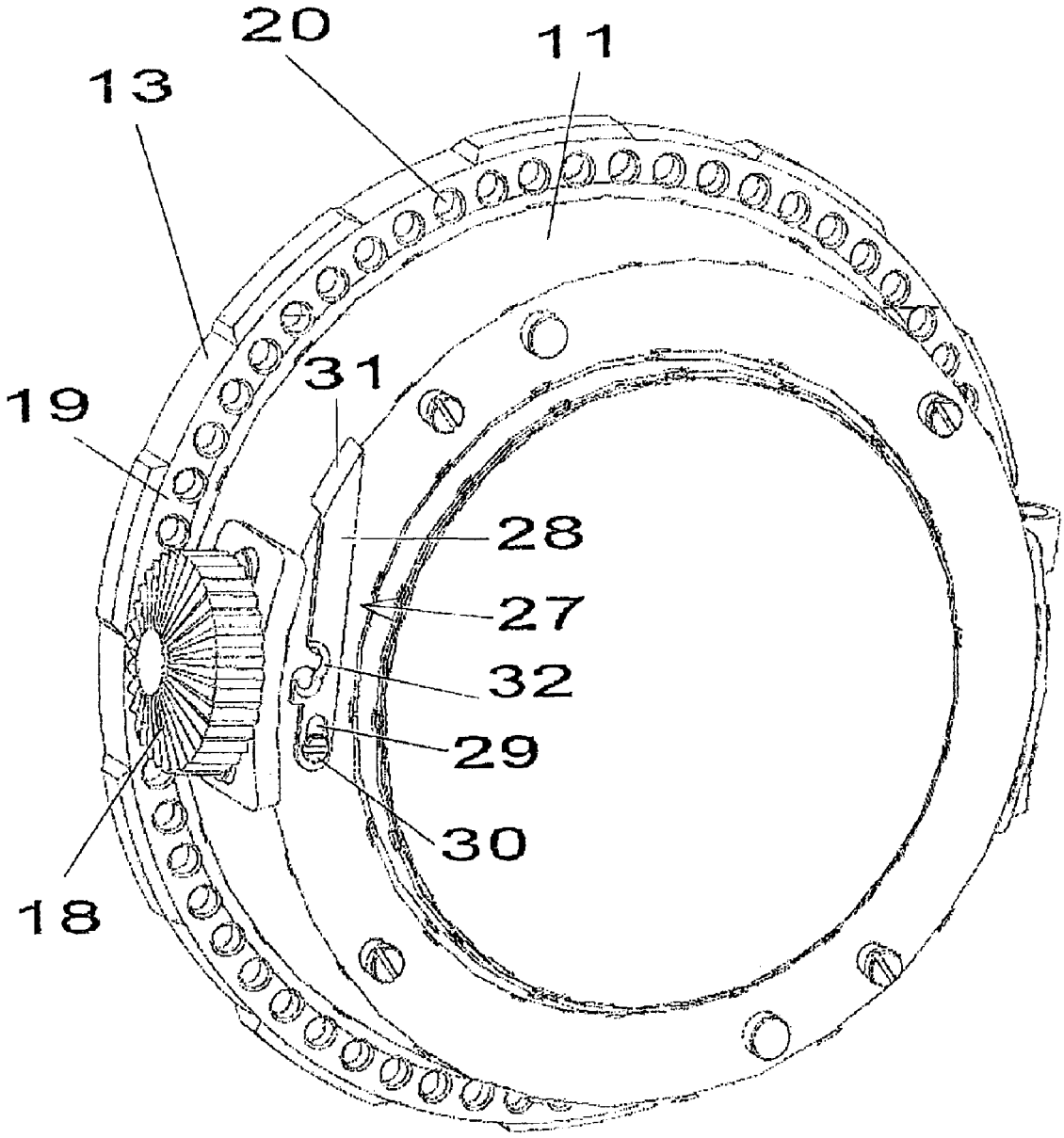
FIG. 3 shows details of embodiment of its locking lever.

With particular reference to FIG. 3, it can be seen that the middle 11, at the 12 o'clock position, is provided with a lever 27 which can be moved in the plane of the watch inside a recess arranged in the back-cover 12. This lever consists of a small plate 28 of which one end has an oblong opening 29 in which a screw 30 can be fixed ensuring its fixing to the middle 11 while leaving it free to move. The plate 28 can therefore take up a first position, shown in the drawing, in which its other end 31 lies flush with the outer face of the middle, and a second position, not shown, in which the end 31 is pressed into the middle. A spring, not visible in the figure, has the function of pushing the plate 28 towards its first position.

The plate 28 has a notch 32 whose role will now be understood.

Referring again to FIGS. 1 and 2, it will be noted that one of the arms 25, at its end opposite the hinge 21, also has a push-piece 33 intended to cooperate with the end 31 of plate 28 so as to counter the action of the spring by pushing it towards its second position.

FIG. 2 shows that the frame 22 at the 12 o'clock position, has a fastening member e.g. a mushroom-shaped pin 34 intended to take up position in the notch 32 of the plate 28 so that, together with push-piece 33, it forms a locking system.

When the plate 28 lies in its first position, the bulbous head of the pin 34 is trapped in notch 32 making it impossible for the frame 22 (to which pin 34 belongs) to be separated from the middle 11 (to which plate 28 belongs). It is therefore no longer possible to rotate the bezel 13 since it is immobilized by the pin 26 implanted in one of its cavities 20.

When, on the contrary, the plate 28 lies in its second position, the head of mushroom pin 34 is released from notch 32, making it possible to separate the frame 22 from the middle 11. The case can then be removed from the frame 22 by pivoting on hinge 21, allowing possible rotation of the bezel.

The catch obtained by cooperation of the male member 38 with the female member allows the case 10 to be held in position after it has pivoted and has been removed from the frame, thereby facilitating adjustment of the bezel 13. The respective positions of the male and female members are adjusted so that the angle, at which the case 10 must pivot so that the catch is engaged, enables easy manipulation of the bezel. By way of indication this angle is approximately 40 to 50°.

Should, either voluntarily or accidentally, a force tend to cause the case 10 to pivot by a larger degree, male member 38 disengages itself from the other member and comes into contact with the protuberance 40. This protuberance is sized so that the member is unable to override it. Therefore, according to the example, the balls are blocked against the bar limiting the movement of the case and preventing the glass from coming up against a surrounding object.

Therefore a diving watch is proposed whose case 10 in normal use is trapped and locked in its frame 22 so that the rotating bezel 13, previously set by the diver, cannot be actuated under any circumstances. The push-piece 33 is used to release the case and cause it to pivot so that it can be removed from the frame in order to rotate the bezel if necessary, to display the desired diving time.

The embodiment described above is given solely to illustrate the invention and is not limiting. Persons skilled in the art may provide for different locking means to maintain the watch case in the position in which the bezel is blocked. Different immobilization means for the bezel may also be provided, for example the frame may comprise a first set of teeth able to cooperate with a second set of teeth provided on the bezel. Also, the pin and tubular elements forming the hinge could be arranged in reverse position i.e. secured to case and frame respectively. The same applies to the elements forming the catch connection between the frame and the case. The frame could be configured to propose several catch points, allowing the case to be held in several positions at different pivot angles. More generally those skilled in the art may make provision for a device other than a slot catch to hold the case in position after it has been removed from the frame.

The invention claimed is:

1. A diver's watch comprising:

a case containing a clockwork movement associated with a time display means, said case being formed of a case middle, a back-cover and a rotating bezel;

a frame on which said case is hinge mounted, said frame being configured so as to define a housing into which said case can be folded down to take up a first position, and locking means to ensure locking of the case in said first position, said locking means comprising an immobilizing means for immobilizing bezel;

wherein said immobilizing means is arranged in such a manner that said bezel is immobilized by said immobilizing means when the case is in its first position, and said bezel is free to rotate when said case is retrieved from said first position.

2. The watch of claim 1, wherein said locking means comprises:

a fastening member secured to the frame and able to cooperate with a locking member arranged on the case, and a control member secured to the frame and arranged to command the locking member or the fastening member in order to command if said fastening and said locking members cooperate together or are free relative to each other.

3. The watch of claim 2, wherein said locking member is a lever secured to the case and able to take up a first position in which it is joined to said fastening member and a second position in which it is separated from said fastening member; and, wherein said control member is a push-piece secured to the frame and arranged to command said lever.

4. The watch of claim 3, wherein said lever is fixed to the middle and arranged inside a recess made in the case.

5. The watch of claim 1, wherein said immobilizing means is provided by the following arrangement:

the rotating bezel has an outer diameter that is notably larger than that of the case middle, and in its peripheral portion offers a plurality of evenly distributed cavities;

the inside of the frame is configured and sized to receive the case middle but not to allow entry of the bezel which therefore comes to lie on the frame; and, said frame is provided with a pin intended arranged to take up a position in one of said cavities so as to immobilize the bezel when placed over it.

6. The watch of claim 2, wherein said immobilizing means is provided by the following arrangement:

the rotating bezel has an outer diameter that is notably larger than that of the case middle, and in its peripheral portion offers a plurality of evenly distributed cavities;

the inside of the frame is configured and sized to receive the case middle but not to allow entry of the bezel which therefore comes to lie on the frame; and, said frame is provided with a pin arranged to take up a position in one of said cavities so as to immobilize the bezel when placed over it.

7. The watch of claim 3, wherein said immobilizing means is provided by the following arrangement:

the rotating bezel has an outer diameter that is notably larger than that of the case middle, and in its peripheral portion offers a plurality of evenly distributed cavities;

the inside of the frame is configured and sized to receive the case middle but not to allow entry of the bezel which therefore comes to lie on the frame; and, said frame is provided with a pin arranged to take up a position in one of said cavities so as to immobilize the bezel when placed over it.

8. The watch of claim 1, wherein the case is hinge mounted on the frame by means of a hinge arranged at the 6 o'clock position.

9. The watch of claim 2, wherein the case is hinge mounted on the frame by means of a hinge arranged at the 6 o'clock position.

10. The watch of claim 3, wherein the case is hinge mounted on the frame by means of a hinge arranged at the 6 o'clock position.

11. The watch of claim 5, wherein the case is hinge mounted on the frame by means of a hinge arranged at the 6 o'clock position.

12. The watch of claim 6, wherein the case is hinge mounted on the frame by means of a hinge arranged at the 6 o'clock position.

13. The watch of claim 7, wherein the case is hinge mounted on the frame by means of a hinge arranged at the 6 o'clock position.

14. The watch of claim 1, whose movement is associated with a command crown, wherein the command crown is arranged at the 12 o'clock position.

15. The watch of claim 2, whose movement is associated with a command crown, wherein the command crown is arranged at the 12 o'clock position.

16. The watch of claim 3, whose movement is associated with a command crown, wherein the command crown is arranged at the 12 o'clock position.

17. The watch of claim 5, whose movement is associated with a command crown, wherein the command crown is arranged at the 12 o'clock position.

18. The watch of claim 6, whose movement is associated with a command crown, wherein the command crown is arranged at the 12 o'clock position.

19. The watch of claim 7, whose movement is associated with a command crown, wherein the command crown is arranged at the 12 o'clock position.

20. The watch of claim 1, comprising means to hold the case in at least one second position in which it is removed from the frame allowing rotation of the bezel.

21. The watch of claim 2, comprising means to hold the case in at least one second position in which it is removed from the frame allowing rotation of the bezel.

22. The watch of claim 3, comprising means to hold the case in at least one second position in which it is removed from the frame allowing rotation of the bezel.

23. The watch of claim 1, comprising a blocker to limit movement of the case with respect to the frame.

24. The watch of claim 2, comprising a blocker to limit movement of the case with respect to the frame.

25. The watch of claim 3, comprising a blocker to limit movement of the case with respect to the frame.

* * * * *